US006258243B1

(12) United States Patent
Heimann et al.

(10) Patent No.: US 6,258,243 B1
(45) **Date of Patent: *Jul. 10, 2001**

(54) CATHODIC PROCESS FOR TREATING AN ELECTRICALLY CONDUCTIVE SURFACE

(75) Inventors: Robert L. Heimann; William M. Dalton; John Hahn; David M. Price, all of Moberly, MO (US)

(73) Assignee: Elisha Technologies Co LLC, Moberly, MO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/122,002

(22) Filed: Jul. 24, 1998

Related U.S. Application Data

(63) Continuation-in-part of application No. 09/016,250, filed on Jan. 30, 1998, now Pat. No. 6,149,794.
(60) Provisional application No. 60/036,024, filed on Jan. 31, 1997, and provisional application No. 60/045,446, filed on May 2, 1997.

(51) Int. Cl.[7] ..... C25D 9/00
(52) U.S. Cl. ..... 205/316; 205/320
(58) Field of Search ..... 205/333, 320–323, 205/316–319, 735

(56) References Cited

U.S. PATENT DOCUMENTS

| | | |
|---|---|---|
| 1,129,320 | 2/1915 | Vail et al. . |
| 1,289,215 | 12/1918 | MacGahan . |
| 1,366,305 | 1/1921 | Whyte . |
| 1,540,766 | 6/1925 | Daniels et al. . |
| 1,744,116 | 1/1930 | Hannen et al. . |
| 1,844,670 | 2/1932 | Manson . |
| 1,909,365 | 5/1933 | Knabner . |
| 1,912,175 | 5/1933 | Blough et al. . |
| 1,946,146 | 2/1934 | Kiefer et al. . |
| 2,462,763 | 2/1949 | Nightingall . |
| 2,475,330 | 7/1949 | Levy . |
| 2,495,457 | 1/1950 | Jacobs . |
| 2,512,563 | 6/1950 | De Long . |
| 2,539,455 | 1/1951 | Mazia . |
| 2,641,556 | 6/1953 | Robinson . |
| 2,780,591 | 2/1957 | Frey . |
| 2,855,328 | 10/1958 | Long . |
| 3,224,927 | 12/1965 | Brown et al. . |
| 3,301,701 | 1/1967 | Baker et al. . |
| 3,444,007 | 5/1969 | Maurer et al. . |
| 3,515,600 | 6/1970 | Jones et al. . |
| 3,658,662 | 4/1972 | Casson, Jr. et al. . |
| 3,663,277 | 5/1972 | Koepp et al. . |
| 3,687,740 | 8/1972 | Pearlstein et al. . |

(List continued on next page.)

FOREIGN PATENT DOCUMENTS

| | | |
|---|---|---|
| 498485 | 2/1939 | (GB) . |
| 5-255889 | 10/1993 | (JP) . |
| H5-255889 | 10/1993 | (JP) . |
| WO 97/03231 | 1/1997 | (WO) . |
| WO 97/40208 | 10/1997 | (WO) . |

OTHER PUBLICATIONS

The Chemistry of Silica—Solubility, Polymerization, Colloid and Surface Properties, and Biochemistry—Ralph K. Iler—John Wiley & Sons—1979, pp. 83–85, 161–163. No month avail.

(List continued on next page.)

*Primary Examiner*—Kathryn Gorgos
*Assistant Examiner*—Wesley A. Nicolas
(74) *Attorney, Agent, or Firm*—Michael K. Boyer

(57) ABSTRACT

The disclosure relates to a process for forming a deposit on the surface of a metallic or conductive surface. The process employs an electrolytic process to deposit a mineral containing coating or film upon a metallic or conductive surface.

30 Claims, 2 Drawing Sheets

U.S. PATENT DOCUMENTS

| | | | | |
|---|---|---|---|---|
| 3,796,608 | | 3/1974 | Pearlman . | |
| 3,839,256 | | 10/1974 | Parkinson . | |
| 3,920,468 | * | 11/1975 | Brown et al. | 205/316 |
| 4,059,658 | | 11/1977 | Shoup et al. . | |
| 4,082,626 | * | 4/1978 | Hradcovsky | 205/106 |
| 4,101,692 | | 7/1978 | Lomasney et al. . | |
| 4,150,191 | | 4/1979 | Karki . | |
| 4,222,779 | | 9/1980 | Bengali et al. . | |
| 4,240,838 | | 12/1980 | Blasko et al. . | |
| 4,288,252 | | 9/1981 | Neely . | |
| 4,367,099 | | 1/1983 | Lash et al. . | |
| 4,412,863 | | 11/1983 | Neely, Jr. . | |
| 4,425,166 | | 1/1984 | Pavlik et al. . | |
| 4,427,499 | * | 1/1984 | Hitomi et al. | 205/156 |
| 4,478,905 | | 10/1984 | Neely, Jr. . | |
| 4,599,371 | * | 7/1986 | Loch et al. | 523/402 |
| 4,705,576 | | 11/1987 | Klos et al. . | |
| 5,221,371 | | 6/1993 | Miller . | |
| 5,338,434 | * | 8/1994 | Ruhl et al. | 205/229 |
| 5,352,342 | | 10/1994 | Riffe . | |
| 5,368,655 | | 11/1994 | Klos . | |
| 5,433,976 | * | 7/1995 | Van Ooij et al. | 427/327 |
| 5,478,451 | | 12/1995 | Riffe . | |
| 5,498,284 | | 3/1996 | Neely, Jr. . | |
| 5,603,818 | | 2/1997 | Brent et al. . | |
| 5,616,229 | | 4/1997 | Samsonov et al. . | |
| 5,653,823 | | 8/1997 | McMillen et al. . | |
| 5,658,697 | | 8/1997 | Lin . | |
| 5,660,707 | | 8/1997 | Shastry et al. . | |
| 5,660,709 | | 8/1997 | Bauer et al. . | |
| 5,672,390 | | 9/1997 | Crews, IV et al. . | |
| 5,674,371 | | 10/1997 | Patel . | |
| 5,674,790 | | 10/1997 | Araujo . | |
| 5,681,378 | | 10/1997 | Kerherve . | |
| 5,681,658 | | 10/1997 | Anderson et al. . | |
| 5,683,522 | | 11/1997 | Joesten . | |
| 5,683,567 | | 11/1997 | Shimamune et al. . | |
| 5,683,568 | | 11/1997 | Harris et al. . | |
| 5,683,751 | | 11/1997 | Derule et al. . | |
| 5,743,953 | | 4/1998 | Twardowska et al. . | |
| 5,750,085 | | 5/1998 | Yamada et al. . | |
| 5,750,188 | | 5/1998 | Menu . | |
| 5,766,564 | | 6/1998 | Tijburg et al. . | |
| 5,807,428 | | 9/1998 | Bose et al. . | |
| 5,824,366 | | 10/1998 | Bose et al. . | |
| 5,868,819 | | 2/1999 | Guhde et al. . | |
| 5,900,136 | | 5/1999 | Gotsu et al. . | |
| 5,906,971 | | 5/1999 | Lark . | |
| 5,916,516 | | 6/1999 | Kolb . | |
| 6,083,362 | | 7/2000 | Hryn et al. . | |
| 6,083,374 | | 7/2000 | Kopp . | |

OTHER PUBLICATIONS

Soluble Silicates Their Properties and Uses—vol. 2: Technology—James G. Vail, D.Sc.–Copyright 1952 1952, pp. 152, 231, and 284. No month available.

ASM Handbook, 1994, pp. 4, 7, 8 and 10. No month avail.

Brown et al.—Silicates as Cleaners in the Producton of Tin Plat e II. Influence of Batch Anneal, Plating, Oct. 1971. No month avail.

ISFEC 92 Conference, Sep. 1992 Watson, et al.—The Electrodeposition of Zinc Chromium Alloys and the Formation of Conversion Coatings Without Use of Chromate Solutions.

Anomalous Codeposition of Fe–Ni Alloys and Fe–Ni–$SiO_2$ Composites under Potentiostatic Conditions—Experimental Study and Mathematical Model—M. Ramasubramanian, S. N. Popova, B. N. Popov, and R. E. White—J.Electrochem Soc., vol. 143, No. 7, Jul. 1996, The Electrochemical Society, Inc.

Electrodeposition & Characterization of a Corrosion Resistant Zinc–Nickel–Phosphorus Alloy, By A. Krishniyer, M. Ramasubramanian, B.N. Popov & R.E. White, Jan. 1999.

Ellipsometric and Raman Spectroscopic Study of Thermally Formed Films on Titanium, E. Hristova and Li. Arsov, B. N. Popov and R.E. White—J. Electrochem Soc., vol. 144, No. 7, Jul. 1997 The Electrochemical Society, Inc.

Mass transport effects on the electrodeposition of ironnickel alloys at the presence of additives—K.M. Yin, J.H. Wei, J.R. Fu, B. N. Popov, S.N. Popova, R.E.White—Journal of Applied Electrochemistry 25 (1995) 543–555.

Development of a New Elect rodeposition Process for Plating of Zn–Ni–X (X= Cd, P) Alloys—I. Corrosion Characteristics of Zn–Ni–Cd Ternary Alloys—Anand Durairajan, Bala S. Haran, Ralph E. White and Branko N. Popov—Journal of The Electrochemical Society, 147 (5) S–2 Proof pp. (2000), No month avail.

Characterization of Hydrogen Permeation through Zinc-Nickel Alloys under Corroding Conditions: Mathematical Model and Experimental Study—M. Ramasubramanian, B.N. Popov, and R.E. White—J. Electrochem. Soc., vol. 145, No. 6, Jun. 1998 The Electrochemical Society, Inc.

Characterization of Hydrogen Permeation Through a Corrosion–Resistant Zinc–Nickel–Phosphorus Alloy, A. Durairajan, A. Krishniyer, B.S. Haran, R.E. White, and B.N. Popov—Corrosion—vol. 56, No. 3, Mar. 2000.

Development of a New Electrodepostion Process for Plating of Zn–Ni–X (X = Cd, P) Alloys Permeation Characteristics of Zn–Ni–Cd Ternary Alloys—A. Durairajan, B.S. Haran, R.E. White, B.N. Popov—Journal of the Electrochemical Society, 147 (12) S–2 (2000). No month avail.

Galvanostatic Pulse and Pulse Reverse Plating of Zinc-Nickel Alloys from Sulfate Electrolytes on a Rotating Disc Electrode—B.N. Popov, M. Ramasubramanian, S.N. Popova, R.E. White and K–M Yin, J. Chem. Soc., Faraday Trans. vol. 92 (4021–4027), 1996. No month avail.

Use of Underpotential Depostion of Zinc to Mitigate Hydrogen Absorption into Monel K500—G. Zheng, B.N. Popov, and R.E. White, Journal Electrochem. soc. 141(5), May 1994.

Galvanostatic Pulse and Pulse Reverse Plating of Nickel–Iron Alloys from Electrolytes Containing Organic Compounds on a Rotating Disk Electrode—B.N. Popov, Ken-Ming Yin, and R.E. White, J. Electrochem. soc. 140(5). May 1993.

* cited by examiner

CATHODIC PROCESS FOR TREATING AN ELECTRICALLY CONDUCTIVE SURFACE

This Application is a continuation in part of U.S. patent application Ser. No. 09/016,250, filed on Jan. 30, 1998 now U.S. Pat. No. 6,149,794, in the names of Robert L. Heimann et al. and entitled "An Electrolytic Process For Forming A Mineral"; the entire disclosure of which is hereby incorporated by reference. The subject matter of this invention claims benefit under 35 U.S.C. 111(a), 35 U.S.C. 119(e) and 35 U.S.C. 120 of U.S. Provisional Patent Application Serial Nos. 60/036,024, filed on Jan. 31, 1997 and Serial No. 60/045,446, filed on May 2, 1997 and entitled "Non-Equilibrium Enhanced Mineral Deposition". The disclosure of the previously filed provisional patent applications is hereby incorporated by reference.

FIELD OF THE INVENTION

The instant invention relates to a process for forming a deposit on the surface of a metallic or conductive surface. The process employs an electrolytic process to deposit a mineral containing coating or film upon a metallic, metal containing or conductive surface.

BACKGROUND OF THE INVENTION

Silicates have been used in electrocleaning operations to clean steel, tin, among other surfaces. Electrocleaning is typically employed as a cleaning step prior to an electroplating operation. Using "Silicates As Cleaners In The Production of Tinplate" is described by L. J. Brown in February 1966 edition of Plating; hereby incorporated by reference.

Processes for electrolytically forming a protective layer or film by using an anodic method are disclosed by U.S. Pat. No. 3,658,662 (Casson, Jr. et al.), and United Kingdom Patent No. 498,485; both of which are hereby incorporated by reference.

U.S. Pat. No. 5,352,342 to Riffe, which issued on Oct. 4, 1994 and is entitled "Method And Apparatus For Preventing Corrosion Of Metal Structures" that describes using electromotive forces upon a zinc solvent containing paint; hereby incorporated by reference.

SUMMARY OF THE INVENTION

The instant invention solves problems associated with conventional practices by providing a cathodic method for forming a protective layer upon a metallic or metal containing substrate. The cathodic method is normally conducted by immersing an electrically conductive substrate into a silicate containing bath wherein a current is passed through the bath and the substrate is the cathode. A mineral layer comprising an amorphous matrix surrounding or incorporating metal silicate crystals forms upon the substrate. The characteristics of the mineral layer are described in greater detail in the copending and commonly patent applications listed below. The mineral layer imparts improved corrosion resistance, among other properties, to the underlying substrate.

The inventive process is also a marked improvement over conventional methods by obviating the need for solvents or solvent containing systems to form a corrosion resistant layer, i.e., a mineral layer. In contrast, to conventional methods the inventive process is substantially solvent free. By "substantially solvent free" it is meant that less than about 5 wt. %, and normally less than about 1 wt. % volatile organic compounds (V.O.C.s) are present in the electrolytic environment.

In contrast to conventional electrocleaning processes, the instant invention employs silicates in a cathodic process for forming a mineral layer upon the substrate. Conventional electro-cleaning processes sought to avoid formation of oxide containing products such as greenalite whereas the instant invention relates to a method for forming silicate containing products, i.e., a mineral.

CROSS REFERENCE TO RELATED PATENTS AND PATENT APPLICATIONS

The subject matter of the instant invention is related to copending and commonly assigned Non-Provisional U.S. patent application Ser. Nos. 08/850,323, now U.S. Pat. Nos. 6,165,257, 08/850,586; and 091016,853 now U.S. Pat. Nos. 6,143,420 and 6,190,774, respectively, (EL001RH-6, EL001RH-7 and EL001RH-8), filed respectively on May 2, 1997 and Jan. 30, 1998, and 08/791,337 (Attorney Docket No. EL001RH-4 filed on Jan. 31, 1997) in the names of Robert L. Heimann et al., as a continuation in part of Ser. No. 08/634,215 (filed on Apr. 18, 1996), and now abaandoned, in the names of Robert L. Heimann et al., and entitled "Corrosion Resistant Buffer System for Metal Products", which is a continuation in part of Non-Provisional U.S patent application Ser. No. 08/476,271 (filed on Jun. 7, 1995), and now abandoned, in the names of Heimann et al., and corresponding to WIPO Patent Application Publication No. WO 96/12770, which in turn is a continuation in part of Non-Provisional U.S. patent application Ser. No. 08/327,438 (filed on Oct. 21, 1994), now U.S. Pat. No. 5,714,093.

The subject matter of this invention is related to Non-Provisional Patent Application Serial No. 09/016,849 (Attorney Docket No. EL004RH-1), which is still pending, filed on even date herewith and entitled "Corrosion Protective Coatings". The subject matter of this invention is also related to Non-Provisional Patent Application Serial No. 09/016,462 (Attorney Docket No. EL005NM-1), filed respectively, on even date herewith and Jan. 31, 1997, and now U.S. Pat. No. 6,033,495, and entitled "Aqueous Gel Compositions and Use Thereof". The disclosure of the previously identified patents, patent applications and publications is hereby incorporated by reference.

DETAILED DESCRIPTION

Figure 1:
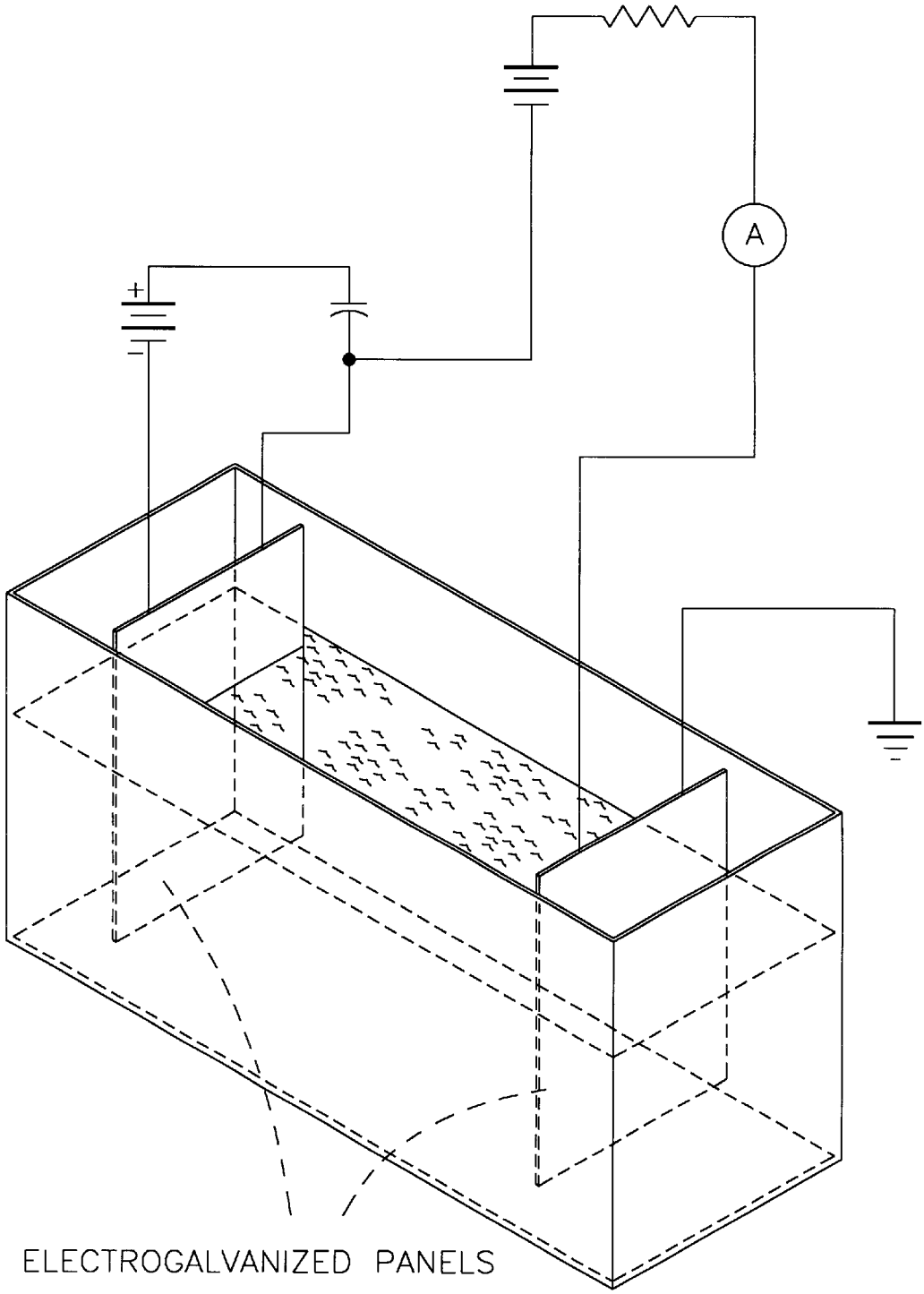
FIG. 1 is a schematic drawing of the circuit and apparatus which can be employed for practicing an aspect of the invention.

The instant invention relates to a process for depositing or forming a mineral containing coating or film upon a metallic or an electrically conductive surface. The process employs a mineral containing solution e.g., containing soluble mineral components, and utilizes an electrically enhanced method to obtain a mineral coating or film upon a metallic or conductive surface. By "mineral containing coating", "mineralized film" or "mineral" it is meant to refer to a relatively thin coating or film which is formed upon a metal or conductive surface wherein at least a portion of the coating or film includes at least one of metal containing mineral, e.g., an amorphous phase or matrix surrounding or incorporating crystals comprising a zinc disilicate. Mineral and Mineral Containing are defined in the previously identified Copending and Commonly Assigned Patents and Patent Applications; incorporated by reference. By "electroyltic" or "electrodeposition" or "electrically enhanced", it is meant to refer to an environment created by passing an electrical current through a silicate containing medium while in contact with an electrically conductive substrate and wherein the substrate functions as the cathode.

The electroyltic environment can be established in any suitable manner including immersing the substrate, applying a silicate containing coating upon the substrate and thereafter applying an electrical current, among others. The preferred method for establishing the environment will be determined by the size of the substrate, electrodeposition time, among other parameters known in the electrodeposition art. The inventive process can be operated on a batch or continuous basis. The electrolytic environment can be preceded by or followed with conventional post and/or pretreatments known in this art such as cleaning or rinsing, e.g., sonic cleaning, double counter-current cascading flow; alkali or acid treatments.

The silicate containing medium can be a fluid bath, gel, spray, among other methods for contacting the substrate with the silicate medium. Examples of the silicate medium comprise a bath containing at least one silicate, a gel comprising at least one silicate and a thickener, among others. Normally, the medium comprises a bath of sodium silicate.

The metal surface refers to a metal article as well as a non-metallic or an electrically conductive member having an adhered metal or conductive layer. Examples of suitable metal surfaces comprise at least one member selected from the group consisting of galvanized surfaces, zinc, iron, steel, brass, copper, nickel, tin, aluminum, lead, cadmium, magnesium, alloys thereof, among others. While the inventive process can be employed to coat a wide range of metal surfaces, e.g., copper, aluminum and ferrous metals, the mineral layer can be formed on a nonconductive substrate having at least one surface coated with an electrically conductive material, e.g., a metallized polymeric sheet or ceramic material encapsulated within a metal. Conductive surfaces can also include carbon or graphite as well as conductive polymers (polyaniline for example).

The metal surface can possess a wide range of sizes and configurations, e.g., fibers, drawn wires or wire strand/rope, rods, particles, fasteners, among others. The limiting characteristic of the inventive process to treat a metal surface is dependent upon the ability of the electrical current to contact the metal surface. That is, similar to conventional electroplating technologies, a mineral surface is difficult to apply upon a metal surface defining hollow areas or voids.

The mineral coating can enhance the surface characteristics of the metal or conductive surface such as resistance to corrosion, protect carbon (fibers for example) from oxidation, hardness and improve bonding strength in composite materials, and reduce the conductivity of conductive polymer surfaces including potential application in sandwich type materials. The mineral coating can also affect the electrical and magnetic properties of the surface.

In an aspect of the invention, an electrogalvanized panel, e.g., a zinc surface, is coated electrolytically by being placed into an aqueous sodium silicate solution. After being placed into the silicate solution, a mineral coating or film containing silicates is deposited by using low voltage and low current.

In one aspect of the invention, the metal surface, e.g., zinc, aluminum, steel, lead and alloys thereof; has an optional pretreated. By "pretreated" it is meant to refer to a batch or continuous process for conditioning the metal surface to clean it and condition the surface to facilitate acceptance of the mineral or silicate containing coating e.g., the inventive process can be employed as a step in a continuous process for producing corrosion resistant coil steel. The particular pretreatment will be a function of composition of the metal surface and desired composition of mineral containing coating/film to be formed on the surface. Examples of suitable pre-treatments comprise at least one of cleaning, e.g., sonic cleaning, activating, and rinsing. One suitable pretreatment process for steel comprises:

1) 2 minute immersion in a 3:1 dilution of Metal Prep 79 (Parker Amchem),
2) two deionized rinses,
3) 10 second immersion in a pH 14 sodium hydroxide solution,
4) remove excess solution and allow to air dry,
5) 5 minute immersion in a 50% hydrogen peroxide solution,
6) remove excess solution and allow to air dry.

In another aspect of the invention, the metal surface is pretreated by anodically cleaning the surface. Such cleaning can be accomplished by immersing the work piece or substrate into a medium comprising silicates, hydroxides, phosphates and carbonates. By using the work piece as the anode in a DC cell and maintaining a current of about 100 $mA/cm^2$, the process can generate oxygen gas. The oxygen gas agitates the surface of the workpiece while oxidizing the substrate's surface. The surface can also be agitated mechanically by using conventional vibrating equipment. If desired, the amount of oxygen or other gas present during formation of the mineral layer can be increased by physically introducing such gas, e.g., bubbling, pumping, among other means for adding gases.

In a further aspect of the invention, the silicate solution is modified to include one or more dopant materials. While the cost and handling characteristics of sodium silicate are desirable, at least one member selected from the group of water soluble salts and oxides of tungsten, molybdenum, chromium, titanium, zirconium, vanadium, phosphorus, aluminum, iron, boron, bismuth, gallium, tellurium, germanium, antimony, niobium (also known as columbium), magnesium and manganese, mixtures thereof, among others, and usually, salts and oxides of aluminum and iron can be employed along with or instead of a silicate. The dopants that can be employed for enhancing the mineral layer formation rate, modifying the chemistry of the mineral layer, as a diluent for the electrolyte or silicate containing medium. Examples of such dopants are iron salts (ferrous sulfate, nitrate), aluminum fluoride, fluorosilicates, mixtures thereof, among other sources of metals and halogens. The dopant materials can be introduced to the metal or conductive surface in pretreatment steps prior to electrodeposition, in post treatment steps following electrodeposition, and/or by alternating electrolytic contacts in solutions of dopants and solutions of silicates if the silicates will not form a stable solution with the dopants, e.g., one or more water soluble dopants. The presence of dopants in the electrolyte solution can be employed to form tailored mineral containing surfaces upon the metal or conductive surface, e.g., an aqueous sodium silicate solution containing aluminate can be employed to form a layer comprising oxides of silicon and aluminum.

The silicate solution can also be modified by adding water soluble polymers, and the electro-deposition solution itself can be in the form of a flowable gel consistency having a predetermined viscosity. A suitable composition can be obtained in an aqueous composition comprising about 3 wt % N-grade Sodium Silicate Solution (PQ Corp), optionally about 0.5 wt % Carbopol EZ-2 (BF Goodrich), about 5 to about 10 wt. % fumed silica, mixtures thereof, among others. Further, the aqueous silicate solution can be filled with a water dispersible polymer such as polyurethane to electro-deposit a mineral-polymer composite coating. The characteristics of the electro-deposition solution can be modified or tailored by using an anode material as a source of ions which can be available for codeposition with the mineral anions and/or one or more dopants. The dopants can be useful for building additional thickness of the electrodeposited mineral layer.

The following sets forth the parameters which may be employed for tailoring the inventive process to obtain a desirable mineral containing coating:

1. Voltage
2. Current Density
3. Apparatus or Cell Design
4. Deposition Time
5. Concentration of the N-grade sodium silicate solution
7. Type and concentration of anions in solution
8. Type and concentration of cations in solution
9. Composition/surface area of the anode
10. Composition/surface area of the cathode
11. Temperature
12. Pressure
13. Type and Concentration of Surface Active Agents The specific ranges of the parameters above depend on the substrate to be deposited on and the intended composition to be deposited. Normally, the temperature of the electrolyte bath ranges from about 25 to about 95 C., the voltage from about 12 to 24 volts, an electrolyte solution concentration from about 5 to about 15 wt. % silicate, contact time with the electrolyte from about 10 to about 50 minutes and anode to cathode surface area ratio of about 0.5:1 to about 2:1. Items 1, 2, 7, and 8 can be especially effective in tailoring the chemical and physical characteristics of the coating. That is, items 1 and 2 can affect the deposition time and coating thickness whereas items 7 and 8 can be employed for introducing dopants that impart desirable chemical characteristics to the coating. The differing types of anions and cations can comprise at least one member selected from the group consisting of Group I metals, Group II metals, transition and rare earth metal oxides, oxyanions such as molybdate, phosphate, titanate, boron nitride, silicon carbide, aluminum nitride, silicon nitride, mixtures thereof, among others.

Figure 2:
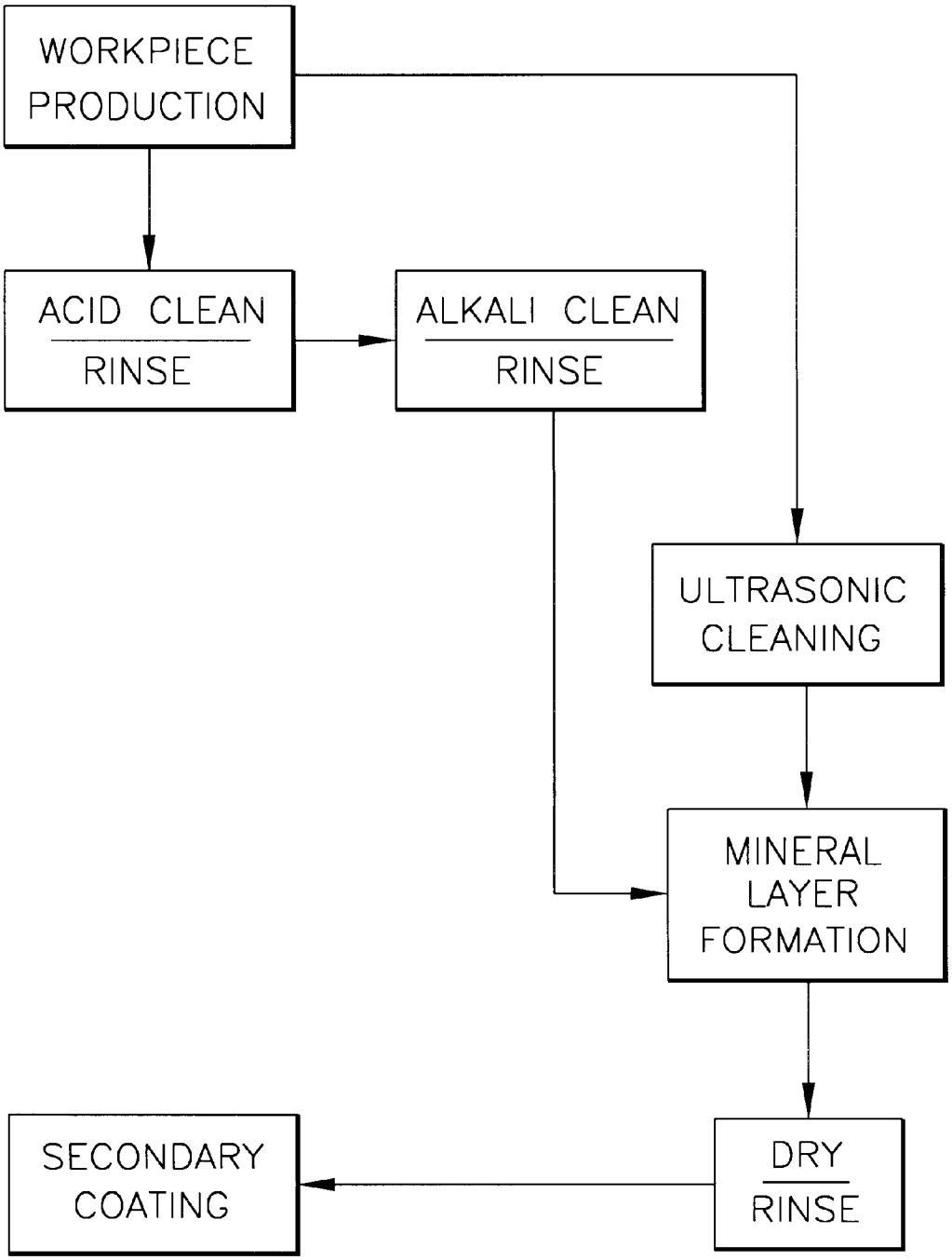
FIG. 2 is a schematic drawing of one process that employs the inventive electrolytic method.

The mineral layer as well as the mineral layer formation process can be modified by varying the composition of the anode. Examples of suitable anodes comprise platinum, zinc, steel, tantalum, niobium, titanium, Monel® alloys, alloys thereof, among others. The anode can release ions into the electrolyte bath that can become incorporated within the mineral layer. Normally, ppm concentrations of anode ions are sufficient to affect the mineral layer composition The mineral layer formation process can be practiced in any suitable apparatus and methods. Examples of suitable apparatus comprise rack and barrel plating, brush plating, among other apparatus conventionally used in electroplating metals. The mineral layer formation process is better understood by referring to the drawings. Referring now to FIG. 2, FIG. 2 illustrates a schematic drawing of one process that employs the inventive electrolytic method. The process illustrated in FIG. 2 can be operated in a batch or continuous process. The articles having a metal surface to be treated (or workpiece) are first cleaned by an acid such as hydrochloric acid, rinsed with water, and rinsed with an alkali such as sodium hydroxide, rinsed again with water. The cleaning and rinsing can be repeated as necessary. If desired the acid/alkali cleaning can be replaced with a conventional sonic cleaning apparatus. The workpiece is then subjected to the inventive electrolytic method thereby forming a mineral coating upon at least a portion of the workpiece surface. The workpiece is removed from the electrolytic environment, dried and rinsed with water. Depending upon the intended usage of the dried mineral-coated workpiece, the workpiece can be coated with a secondary coating or layer. Examples of such secondary coatings or layers comprise one or more members of acrylic coatings (e.g., IRALAC), silanes, urethane, epoxies, among others. The secondary coatings can be applied by using an suitable conventional method such as immersing, dip-spin, spraying, among other methods. The secondary coatings can be employed for imparting a wide range of properties such as improved corrosion resistance to the underlying mineral layer, a temporary coating for shipping the mineral coated workpiece, among other utilities. The mineral coated workpiece, with or without the secondary coating, can be used as a finished product or a component to fabricate another article.

Without wishing to be bound by any theory or explanation a silica containing layer can be formed upon the mineral. The silica containing layer can be chemically or physically modified and employed as an intermediate or tie-layer. The tie-layer can be used to enhance bonding to paints, coatings, metals, glass, among other materials contacting the tie-layer. This can be accomplished by binding to the top silica containing layer one or more materials which contain alkyl, fluorine, vinyl, epoxy, silane, hydroxy, mixtures thereof, among other functionalities. Alternatively, the silica containing layer can be removed by using conventional cleaning methods, e.g, rinsing with de-ionized water. The silica containing tie-layer can be relatively thin in comparison to the mineral layer 100–500 angstroms compared to the total thickness of the mineral which can be 1500–2500 angstroms thick.

While the above description places particular emphasis upon forming a mineral containing layer upon a metal surface, the inventive process can be combined with or replace conventional metal pre or post treatment and/or finishing practices. Conventional post coating baking methods can be employed for modifying the physical characteristics of the mineral layer, remove water and/or hydrogen, among other modifications. The inventive mineral layer can be employed to protect a metal finish from corrosion thereby replacing conventional phosphating process, e.g., in the case of automotive metal finishing the inventive process could be utilized instead of phosphates and chromates and prior to coating application e.g., E-Coat. Further, the aforementioned aqueous mineral solution can be replaced with an aqueous polyurethane based solution containing soluble silicates and employed as a replacement for the so-called automotive E-coating and/or powder painting process. The mineral forming process can be employed for imparting enhanced corrosion resistance to electronic components, e.g., such as the electric motor shafts as demonstrated by Examples 10–11. The inventive process can also be employed in a virtually unlimited array of end-uses such as in conventional plating operations as well as being adaptable to field service. For example, the inventive mineral containing coating can be employed to fabricate corrosion resistant metal products that conventionally utilize zinc as a protective coating, e.g., automotive bodies and components, grain silos, bridges, among many other end-uses.

Moreover, depending upon the dopants and concentration thereof present in the mineral deposition solution, the inventive process can produce microelectronic films, e.g., on metal or conductive surfaces in order to impart enhanced electrical/magnetic and corrosion resistance, or to resist ultraviolet light and monotomic oxygen containing environments such as outer space.

The following Examples are provided to illustrate certain aspects of the invention and it is understood that such an Example does not limit the scope of the invention as defined in the appended claims. The x-ray photoelectron spectroscopy (ESCA) data in the following Examples demonstrate the presence of a unique metal disilicate species within the mineralized layer, e.g., ESCA measures the binding energy of the photoelectrons of the atoms present to determine bonding characteristics.

EXAMPLE 1

The following apparatus and materials were employed in this Example:

Standard Electrogalvanized Test Panels, ACT Laboratories
10% (by weight) N-grade Sodium Silicate solution
12 Volt EverReady® battery
1.5 Volt Ray-O-Vac® Heavy Duty Dry Cell Battery
Triplett RMS Digital Multimeter
30 $\mu$F Capacitor
29.8 kΩ Resistor A schematic of the circuit and apparatus which were employed for practicing the Example are illustrated in FIG. 1. Referring now to FIG. 1, the aforementioned test panels were contacted with a solution comprising 10% sodium mineral and de-ionized water. A current was passed through the circuit and solution in the manner illustrated in FIG. 1. The test panels was exposed for 74 hours under ambient environmental conditions. A visual inspection of the panels indicated that a light-gray colored coating or film was deposited upon the test panel.

In order to ascertain the corrosion protection afforded by the mineral containing coating, the coated panels were tested in accordance with ASTM Procedure No. B117. A section of the panels was covered with tape so that only the coated area was exposed and, thereafter, the taped panels were placed into salt spray. For purposes of comparison, the following panels were also tested in accordance with ASTM Procedure No. B117, 1) Bare Electrogalvanized Panel, and 2) Bare Electrogalvanized Panel soaked for 70 hours in a 10% Sodium Mineral Solution. In addition, bare zinc phosphate coated steel panels(ACT B952, no Parcolene) and bare iron phosphate coated steel panels (ACT B 1000, no Parcolene) were subjected to salt spray for reference.

The results of the ASTM Procedure are listed in the Table below:

| Panel Description | Hours in B117 Salt Spray |
|---|---|
| Zinc phosphate coated steel | 1 |
| Iron phosphate coated steel | 1 |
| Standard Bare Electrogalvanize Panel | ≈120 |
| Standard Panel with Sodium Mineral Soak | ≈120 |
| Coated Cathode of the Invention | 240+ |

The above Table illustrates that the instant invention forms a coating or film which imparts markedly improved corrosion resistance. It is also apparent that the process has resulted in a corrosion protective film that lengthens the life of electrogalvanized metal substrates and surfaces.

ESCA analysis was performed on the zinc surface in accordance with conventional techniques and under the following conditions:

Analytical conditions for ESCA:

| | |
|---|---|
| Instrument | Physical Electronics Model 5701 LSci |
| X-ray source | Monochromatic aluminum |
| Source power | 350 watts |
| Analysis region | 2 mm × 0.8 mm |
| Exit angle* | 50° |
| Electron acceptance angle | ±7° |
| Charge neutralization | electron flood gun |
| Charge correction | C-(C,H) in C 1s spectra at 284.6 eV |

*Exit angle is defined as the angle between the sample plane and the electron analyzer lens.

The silicon photoelectron binding energy was used to characterized the nature of the formed species within the mineralized layer that was formed on the cathode. This species was identified as a zinc disilicate modified by the presence of sodium ion by the binding energy of 102.1 eV for the Si(2p) photoelectron.

EXAMPLE 2

This Example illustrates performing the inventive electrodeposition process at an increased voltage and current in comparison to Example 1.

Prior to the electrodeposition, the cathode panel was subjected to preconditioning process:

1) 2 minute immersion in a 3:1 dilution of Metal Prep 79 (Parker Amchem),
2) two de-ionized rinse,
3) 10 second immersion in a pH 14 sodium hydroxide solution,
4) remove excess solution and allow to air dry,
5) 5 minute immersion in a 50% hydrogen peroxide solution,
6) Blot to remove excess solution and allow to air dry.

A power supply was connected to an electrodeposition cell consisting of a plastic cup containing two standard ACT cold roll steel (clean, unpolished) test panels. One end of the test panel was immersed in a solution consisting of 10% N grade sodium mineral (PQ Corp.) in de-ionized water. The immersed area (1 side) of each panel was approximately 3 inches by 4 inches (12 sq. in.) for a 1:1 anode to cathode ratio. The panels were connected directly to the DC power supply and a voltage of 6 volts was applied for 1 hour. The resulting current ranged from approximately 0.7–1.9 Amperes. The resultant current density ranged from 0.05–0.16 amps/in$^2$.

After the electrolytic process, the coated panel was allowed to dry at ambient conditions and then evaluated for humidity resistance in accordance with ASTM Test No. D2247 by visually monitoring the corrosion activity until development of red corrosion upon 5% of the panel surface area. The coated test panels lasted 25 hours until the first appearance of red corrosion and 120 hours until 5% red corrosion. In comparison, conventional iron and zinc phosphated steel panels develop first corrosion and 5% red corrosion after 7 hours in ASTM D2247 humidity exposure. The above Examples, therefore, illustrate that the inventive process offers an improvement in corrosion resistance over iron and zinc phosphated steel panels.

EXAMPLE 3

Two lead panels were prepared from commercial lead sheathing and cleaned in 6M HCl for 25 minutes. The cleaned lead panels were subsequently placed in a solution comprising 1 wt. % N-grade sodium silicate (supplied by PQ Corporation).

One lead panel was connected to a DC power supply as the anode and the other was a cathode. A potentional of 20 volts was applied initially to produce a current ranging from 0.9 to 1.3 Amperes. After approximately 75 minutes the panels were removed from the sodium silicate solution and rinsed with de-ionized water.

ESCA analysis was performed on the lead surface. The silicon photoelectron binding energy was used to characterized the nature of the formed species within the mineralized layer. This species was identified as a lead disilicate modified by the presence of sodium ion by the binding energy of 102.0 eV for the Si(2p) photoelectron.

EXAMPLE 4

This Example demonstrates forming a mineral surface upon an aluminum substrate. Using the same apparatus in Example 1, aluminum coupons (3"×6") were reacted to form the metal silicate surface. Two different alloys of aluminum were used, Al 2024 and Al 7075. Prior to the panels being subjected to the electrolytic process, each panel was prepared using the methods outlined below in Table A. Each panel was washed with reagent alcohol to remove any excessive dirt and oils. The panels were either cleaned with Alumiprep 33, subjected to anodic cleaning or both. Both forms of cleaning are designed to remove excess aluminum oxides. Anodic cleaning was accomplished by placing the working panel as an anode into an aqueous solution containing 5% NaOH, 2.4% $Na_2CO_3$, 2% $Na_2SiO_3$, 0.6% $Na_3PO_4$, and applying a potential to maintain a current density of 100 mA/cm$^2$ across the immersed area of the panel for one minute.

Once the panel was cleaned, it was placed in a I liter beaker filled with 800 mL of solution. The baths were prepared using de-ionized water and the contents are shown in the table below. The panel was attached to the negative lead of a DC power supply by a wire while another panel was attached to the positive lead. The two panels were spaced 2 inches apart from each other. The potential was set to the voltage shown on the table and the cell was run for one hour.

TABLE A

| Example | A | B | C | D | E | F | G | H |
|---|---|---|---|---|---|---|---|---|
| Alloy type | 2024 | 2024 | 2024 | 2024 | 7075 | 7075 | 7075 | 7075 |
| Anodic Cleaning | Yes | Yes | No | No | Yes | Yes | No | No |
| Acid Wash Bath Solution | Yes | Yes | Yes | Yes | Yes | Yes | Yes | Yes |
| $Na_2SiO_3$ | 1% | 10% | 1% | 10% | 1% | 10% | 1% | 10% |
| $H_2O_2$ | 1% | 0% | 0% | 1% | 1% | 0% | 0% | 1% |
| Potential | 12 V | 18 V | 12 V | 18 V | 12 V | 18 V | 12 V | 18 V |

ESCA was used to analyze the surface of each of the substrates. Every sample measured showed a mixture of silica and metal silicate. Without wishing to be bound by any theory or explanation, it is believed that the metal silicate is a result of the reaction between the metal cations of the surface and the alkali silicates of the coating. It is also believed that the silica is a result of either excess silicates from the reaction or precipitated silica from the coating removal process. The metal silicate is indicated by a Si (2p) binding energy (BE) in the low 102 eV range, typically between 102.1 to 102.3. The silica can be seen by Si(2p) BE between 103.3 to 103.6 eV. The resulting spectra show overlapping peaks, upon deconvolution reveal binding energies in the ranges representative of metal silicate and silica.

EXAMPLE 5

This Example illustrates an alternative to immersion for creating the silicate containing medium.

An aqueous gel made by blending 5% sodium silicate and 10% fumed silica was used to coat cold rolled steel panels. One panel was washed with reagent alcohol, while the other panel was washed in a phosphoric acid based metal prep, followed by a sodium hydroxide wash and a hydrogen peroxide bath. The apparatus was set up using a DC power supply connecting the positive lead to the steel panel and the negative lead to a platinum wire wrapped with glass wool. This setup was designed to simulate a brush plating operation. The "brush" was immersed in the gel solution to allow for complete saturation. The potential was set for 12V and the gel was painted onto the panel with the brush. As the brush passed over the surface of the panel, hydrogen gas evolution could be seen. The gel was brushed on for five minutes and the panel was then washed with deionized water to remove any excess gel and unreacted silicates.

ESCA was used to analyze the surface of each steel panel. ESCA detects the reaction products between the metal substrate and the environment created by the electrolytic process. Every sample measured showed a mixture of silica and metal silicate. The metal silicate is a result of the reaction between the metal cations of the surface and the alkali silicates of the coating. The silica is a result of either excess silicates from the reaction or precipitated silica from the coating removal process. The metal silicate is indicated by a Si (2p) binding energy (BE) in the low 102 eV range, typically between 102.1 to 102.3. The silica can be seen by Si(2p) BE between 103.3 to 103.6 eV. The resulting spectra show overlapping peaks, upon deconvolution reveal binding energies in the ranges representative of metal silicate and silica.

EXAMPLE 6

Using the same apparatus described in Example 1, cold rolled steel coupons (ACT laboratories) were reacted to form the metal silicate surface. Prior to the panels being subjected to the electrolytic process, each panel was prepared using the methods outlined below in Table B. Each panel was washed with reagent alcohol to remove any excessive dirt and oils. The panels were either cleaned with Metalprep 79 (Parker Amchem), subjected to anodic cleaning or both. Both forms of cleaning are designed to remove excess metal oxides. Anodic cleaning was accomplished by placing the working panel as an anode into an aqueous solution containing 5% NaOH, 2.4% $Na_2CO_3$, 2% $Na_2SiO_3$, 0.6% $Na_3PO_4$, and applying a potential to maintain a current density of 100 mA/cm$^2$ across the immersed area of the panel for one minute.

Once the panel was cleaned, it was placed in a Iliter beaker filled with 800 mL of solution. The baths were prepared using de-ionized water and the contents are shown in the table below. The panel was attached to the negative lead of a DC power supply by a wire while another panel was attached to the positive lead. The two panels were spaced 2 inches apart from each other. The potential was set to the voltage shown on the table and the cell was run for one hour.

TABLE B

| Example | AA | BB | CC | DD | EE |
|---|---|---|---|---|---|
| Substrate type | CRS | CRS | CRS | CRS[1] | CRS[2] |
| Anodic Cleaning | No | Yes | No | No | No |
| Acid Wash | Yes | Yes | Yes | No | No |
| Bath Solution $Na_2SiO_3$ | 1% | 10% | 1% | — | — |
| Potential (V) | 14–24 | 6 (CV) | 12 V (CV) | — | — |
| Current Density (mA/cm$^2$) | 23 (CC) | 23-10 | 85-48 | — | — |
| B177 | 2 hrs | 1 hr | 1 hr | 0.25 hr | 0.25 hr |

[1]Cold Rolled Steel Control- No treatment was done to this panel.
[2]Cold Rolled Steel with iron phosphate treatment (ACT Laboratories)- No further treatments were performed The electrolytic process was either run as a constant current or constant voltage experiment, designated by the CV or CC symbol in the table. Constant Voltage experiments applied a constant potential to the cell allowing the current to fluctuate while Constant Current experiments held the current by adjusting the potential. Panels were tested for corrosion protection using ASTM B 117. Failures were determined at 5% surface coverage of red rust.

ESCA was used to analyze the surface of each of the substrates. ESCA detects the reaction products between the metal substrate and the environment created by the electrolytic process. Every sample measured showed a mixture of silica and metal silicate. The metal silicate is a result of the reaction between the metal cations of the surface and the alkali silicates of the coating. The silica is a result of either excess silicates from the reaction or precipitated silica from the coating removal process. The metal silicate is indicated by a Si (2p) binding energy (BE) in the low 102 eV range, typically between 102.1 to 102.3. The silica can be seen by Si(2p) BE between 103.3 to 103.6 eV. The resulting spectra show overlapping peaks, upon deconvolution reveal binding energies in the ranges representative of metal silicate and silica.

EXAMPLE 7

Using the same apparatus as described in Example 1, zinc galvanized steel coupons (EZG 60G ACT Laboratories) were reacted to form the metal silicate surface. Prior to the panels being subjected to the electrolytic process, each panel was prepared using the methods outlined below in Table C. Each panel was washed with reagent alcohol to remove any excessive dirt and oils.

Once the panel was cleaned, it was placed in a 1 liter beaker filled with 800 mL of solution. The baths were prepared using de-ionized water and the contents are shown in the table below. The panel was attached to the negative lead of a DC power supply by a wire while another panel was attached to the positive lead. The two panels were spaced approximately 2 inches apart from each other. The potential was set to the voltage shown on the table and the cell was run for one hour.

TABLE C

| Example | A1 | B2 | C3 | D5 |
|---|---|---|---|---|
| Substrate type | GS | GS | GS | GS[1] |
| Bath Solution $Na_2SiO_3$ | 10% | 1% | 10% | — |
| Potential (V) | 6 (CV) | 10 (CV) | 18 (CV) | — |

TABLE C-continued

| Example | A1 | B2 | C3 | D5 |
|---|---|---|---|---|
| Current Density (mA/cm$^2$) | 22-3 | 7-3 | 142-3 | — |
| B177 | 336 hrs | 224 hrs | 216 hrs | 96 hrs |

[1]Galvanized Steel Control- No treatment was done to this panel.

Panels were tested for corrosion protection using ASTM B 117. Failures were determined at 5% surface coverage of red rust.

ESCA was used to analyze the surface of each of the substrates. ESCA detects the reaction products between the metal substrate and the environment created by the electrolytic process. Every sample measured showed a mixture of silica and metal silicate. The metal silicate is a result of the reaction between the metal cations of the surface and the alkali silicates of the coating. The silica is a result of either excess silicates from the reaction or precipitated silica from the coating removal process. The metal silicate is indicated by a Si (2p) binding energy (BE) in the low 102 eV range, typically between 102.1 to 102.3. The silica can be seen by Si(2p) BE between 103.3 to 103.6 eV. The resulting spectra show overlapping peaks, upon deconvolution reveal binding energies in the ranges representative of metal silicate and silica.

EXAMPLE 8

Using the same apparatus as described in Example 1, copper coupons (C110 Hard, Fullerton Metals) were reacted to form the mineralized surface. Prior to the panels being subjected to the electrolytic process, each panel was prepared using the methods outlined below in Table D. Each panel was washed with reagent alcohol to remove any excessive dirt and oils.

Once the panel was cleaned, it was placed in a 1 liter beaker filled with 800 mL of solution. The baths were prepared using de-ionized water and the contents are shown in the table below. The panel was attached to the negative lead of a DC power supply by a wire while another panel was attached to the positive lead. The two panels were spaced 2 inches apart from each other. The potential was set to the voltage shown on the table and the cell was run for one hour.

TABLE D

| Example | AA1 | BB2 | CC3 | DD4 | EE5 |
|---|---|---|---|---|---|
| Substrate type | Cu | Cu | Cu | Cu | Cu[1] |
| Bath Solution $Na_2SiO_3$ | 10% | 10% | 1% | 1% | — |
| Potential (V) | 12 (CV) | 6 (CV) | 6 (CV) | 36 (CV) | — |
| Current Density (mA/cm$^2$) | 40-17 | 19-9 | 4-1 | 36-10 | — |
| B117 | 11 hrs | 11 hrs | 5 hrs | 5 hrs | 2 hrs |

[1]Copper Control- No treatment was done to this panel.

Panels were tested for corrosion protection using ASTM B117. Failures were determined by the presence of copper oxide which was indicated by the appearance of a dull haze over the surface.

ESCA was used to analyze the surface of each of the substrates. ESCA allows us to examine the reaction products between the metal substrate and the environment set up from the electrolytic process. Every sample measured showed a mixture of silica and metal silicate. The metal silicate is a result of the reaction between the metal cations of the surface and the alkali silicates of the coating. The silica is a result of either excess silicates from the reaction or precipitated silica from the coating removal process. The metal silicate is indicated by a Si (2p) binding energy (BE) in the low 102 eV range, typically between 102.1 to 102.3. The silica can be seen by Si(2p) BE between 103.3 to 103.6 eV. The resulting spectra show overlapping peaks, upon deconvolution reveal binding energies in the ranges representative of metal silicate and silica.

EXAMPLE 9

An electrochemical cell was set up using a 1 liter beaker. The beaker was filled with a sodium silicate solution comprising 10 wt % N sodium silicate solution (PQ Corp). The temperature of the solution was adjusted by placing the beaker into a water bath to control the temperature. Cold rolled steel coupons (ACT labs, 3×6 inches) were used as anode and cathode materials. The panels are placed into the beaker spaced 1 inch apart facing each other. The working piece was established as the anode. The anode and cathode are connected to a DC power source. The table below shows the voltages, solutions used, time of electrolysis, current density, temperature and corrosion performance.

TABLE E

| Sample | Silicate Conc. Wt % | Bath Temp ° C. | Voltage Volts | Current Density mA/cm$^2$ | Bath Time min. | Corrosion Hours (B117) |
|---|---|---|---|---|---|---|
| I-A | 10% | 24 | 12 | 44–48 | 5 | 1 |
| I-B | 10% | 24 | 12 | 49–55 | 5 | 2 |
| I-C | 10% | 37 | 12 | 48–60 | 30 | 71 |
| I-D | 10% | 39 | 12 | 53–68 | 30 | 5 |
| I-F | 10% | 67 | 12 | 68–56 | 60 | 2 |
| I-G | 10% | 64 | 12 | 70–51 | 60 | 75 |
| I-H | NA | NA | NA | NA | NA | 0.5 |

The panels were rinsed with de-ionized water to remove any excess silicates that may have been drawn from the bath solution. The panels underwent corrosion testing according to ASTM B117. The time it took for the panels to reach 5% red rust coverage (as determined by visual observation) in the corrosion chamber was recorded as shown in the above table. Example I-H shows the corrosion results of the same steel panel that did not undergo any treatment.

Example 10

Examples 10, 11, and 14 demonstrate one particular aspect of the invention, namely, imparting corrosion resistance to steel shafts that are incorporated within electric motors. The motor shafts were obtained from Emerson Electric Co. from St. Louis, Mo. and are used to hold the rotor assemblies. The shafts measure 25 cm in length and 1.5 cm in diameter and are made from commercially available steel.

An electrochemical cell was set up similar to that in Example 9; except that the cell was arranged to hold the previously described steel motor shaft. The shaft was set up as the cathode while two cold rolled steel panels were used as anodes arranged so that each panel was placed on opposite sides of the shaft. The voltage and temperature were adjusted as shown in the following table. Also shown in the table is the current density of the anodes

TABLE F

| Sample | Silicate Conc. Wt % | Bath Temp ° C. | Voltage Volts | Current Density mA/cm$^2$ | Bath Time min. | Corrosion Hours |
|---|---|---|---|---|---|---|
| II-A | 10% | 27 | 6 | 17–9 | 60 | 3 |
| II-B | 10% | 60 | 12 | 47–35 | 60 | 3 |
| II-C | 10% | 75 | 12 | 59–45 | 60 | 7 |
| II-D | 10% | 93 | 12 | 99–63 | 60 | 24 |
| II-F | 10% | 96 | 18 | 90–59 | 60 | 24 |
| II-G | NA | NA | NA | NA | NA | 2 |
| II-H | NA | NA | NA | NA | NA | 3 |

The shafts were rinsed with de-ionized water to remove any excess silicates that may have been drawn from the bath solution. Example II-A showed no significant color change compared to Examples II-B–II-F due to the treatment. Example II-B showed a slight yellow/gold tint. Example II-C showed a light blue and slightly pearlescent color. Example II-D and II- showed a darker blue color due to the treatment. The panels underwent corrosion testing according to ASTM B117. The time it took for the shafts to reach 5% red rust coverage in the corrosion chamber was recorded as shown in the table. Example II-G shows the corrosion results of the same steel shaft that did not undergo any treatment and Example II-H shows the corrosion results of the same steel shaft with a commercial zinc phosphate coating.

Example 11

An electrochemical cell was set up similar to that in Example 10 to treat steel shafts. The motor shafts were obtained from Emerson Electric Co. of St. Louis, Mo. and are used to hold the rotor assemblies. The shafts measure 25 cm in length and 1.5 cm in diameter and are made from commercially available steel. The shaft was set up as the cathode while two cold rolled steel panels were used as anodes arranged so that each panel was placed on opposite sides of the shaft. The voltage and temperature were adjusted as shown in the following table. Also shown in the table is the current density of the anodes

TABLE G

| Sample | Silicate Conc. Wt % | Bath Temp ° C. | Voltage Volts | Current Density mA/cm$^2$ | Bath Time min. | Corrosion Hours |
|---|---|---|---|---|---|---|
| III-A | 10% | 92 | 12 | 90–56 | 60 | 504 |
| III-B | 10% | 73 | 12 | 50–44 | 60 | 552 |
| III-C | NA | NA | NA | NA | NA | 3 |
| III-D | NA | NA | NA | NA | NA | 3 |

The shafts were rinsed with de-ionized water to remove any excess silicates that may have been drawn from the bath solution. The panels underwent corrosion testing according to ASTM D2247. The time it too for the shafts to reach 5% red rust coverage in the corrosion chamber was recorded as shown in the table. Example III-C shows the corrosion results of the same steel shaft that did not undergo any treatment and Example III-D shows the corrosion results of the same steel shaft with a commercial zinc phosphate coating.

Example 12

An electrochemical cell was set up using a 1 liter beaker. The solution was filled with sodium silicate solution comprising 5,10, or 15 wt % of N sodium silicate solution (PQ Corporation). The temperature of the solution was adjusted by placing the beaker into a water bath to control the temperature. Cold rolled steel coupons (ACT labs, 3×6 inches) were used as anode and cathode materials. The panels are placed into the beaker spaced 1 inch apart facing each other. The working piece is set up as the anode. The anode and cathode are connected to a DC power source. The table below shows the voltages, solutions used, time of electrolysis, current density through the cathode, temperature, anode to cathode size ratio, and corrosion performance.

TABLE H

| Sample # | Silicate Conc. Wt % | Bath Temp ° C. | Voltage Volts | Current Density mA/cm$^2$ | A/C ratio | Bath Time min. | Corrosion Hours |
|---|---|---|---|---|---|---|---|
| IV-1 | 5 | 55 | 12 | 49–51 | 0.5 | 15 | 2 |
| IV-2 | 5 | 55 | 18 | 107–90 | 2 | 45 | 1 |
| IV-3 | 5 | 55 | 24 | 111–122 | 1 | 30 | 4 |
| IV-4 | 5 | 75 | 12 | 86–52 | 2 | 45 | 2 |
| IV-5 | 5 | 75 | 18 | 111–112 | 1 | 30 | 3 |
| IV-6 | 5 | 75 | 24 | 140–134 | 0.5 | 15 | 2 |
| IV-7 | 5 | 95 | 12 | 83–49 | 1 | 30 | 1 |
| IV-8 | 5 | 95 | 18 | 129–69 | 0.5 | 15 | 1 |
| IV-9 | 5 | 95 | 24 | 196–120 | 2 | 45 | 4 |
| IV-10 | 10 | 55 | 12 | 101–53 | 2 | 30 | 3 |
| IV-11 | 10 | 55 | 18 | 146–27 | 1 | 15 | 4 |
| IV-12 | 10 | 55 | 24 | 252–186 | 0.5 | 45 | 7 |
| IV-13 | 10 | 75 | 12 | 108–36 | 1 | 15 | 4 |
| IV-14 | 10 | 75 | 18 | 212–163 | 0.5 | 45 | 4 |
| IV-15 | 10 | 75 | 24 | 248–90 | 2 | 30 | 16 |
| IV-16 | 10 | 95 | 12 | 168–161 | 0.5 | 45 | 4 |
| IV-17 | 10 | 95 | 18 | 257–95 | 2 | 30 | 6 |
| IV-18 | 10 | 95 | 24 | 273–75 | 1 | 15 | 4 |
| IV-19 | 15 | 55 | 12 | 140–103 | 1 | 45 | 4 |
| IV-20 | 15 | 55 | 18 | 202–87 | 0.5 | 30 | 4 |
| IV-21 | 15 | 55 | 24 | 215–31 | 2 | 15 | 17 |
| IV-22 | 15 | 75 | 12 | 174–86 | 0.5 | 30 | 17 |
| IV-23 | 15 | 75 | 18 | 192–47 | 2 | 15 | 15 |
| IV-24 | 15 | 75 | 24 | 273–251 | 1 | 45 | 4 |
| IV-25 | 15 | 95 | 12 | 183–75 | 2 | 15 | 8 |
| IV-26 | 15 | 95 | 18 | 273–212 | 1 | 45 | 4 |
| IV-27 | 15 | 95 | 24 | 273–199 | 0.5 | 30 | 15 |
| IV-28 | NA | NA | NA | NA | NA | NA | 0.5 |

The panels were rinsed with de-ionized water to remove any excess silicates that may have been drawn from the bath solution. The panels underwent corrosion testing according to ASTM B117. The time it took for the panels to reach 5% red rust coverage in the corrosion chamber was recorded as shown in the table. Example IV-28 shows the corrosion results of the same steel panel that did not undergo any treatment. The table above shows the that corrosion performance increases with silicate concentration in the bath and elevated temperatures. Corrosion protection can also be achieved within 15 minutes. With a higher current density, the corrosion performance can be enhanced further.

Example 13

An electrochemical cell was set up using a 1 liter beaker. The solution was filled with sodium silicate solution comprising 10 wt % N sodium silicate solution is (PQ Corporation). The temperature of the solution was adjusted by placing the beaker into a water bath to control the temperature. Zinc galvanized steel coupons (ACT labs, 3×6 inches) were used as cathode materials. Plates of zinc were used as anode material. The panels are placed into the beaker spaced 1 inch apart facing each other. The working piece was set up as the anode. The anode and cathode are connected to a DC power source. The table below shows the voltages, solutions used, time of electrolysis, current density, and corrosion performance.

TABLE I

| Sample # | Silicate Conc. Wt % | Voltage Volts | Current Density mA/cm$^2$ | Bath Time min. | Corrosion (W) Hours | Corrosion (R) Hours |
|---|---|---|---|---|---|---|
| V-A | 10% | 6 | 33–1 | 60 | 16 | 168 |
| V-B | 10% | 3 | 6.5–1 | 60 | 17 | 168 |
| V-C | 10% | 18 | 107–8 | 60 | 22 | 276 |
| V-D | 10% | 24 | 260–7 | 60 | 24 | 276 |
| V-E | NA | NA | NA | NA | 10 | 72 |

The panels were rinsed with de-ionized water to remove any excess silicates that may have been drawn from the bath solution. The panels underwent corrosion testing according to ASTM B117. The time when the panels showed indications of pitting and zinc oxide formation is shown as Corrosion (W). The time it took for the panels to reach 5% red rust coverage in the corrosion chamber was recorded as shown in the table as Corrosion (R). Example V-E shows the corrosion results of the same steel panel that did not undergo any treatment.

EXAMPLE 14

An electrochemical cell was set up similar to that in Examples 10–12 to treat steel shafts. The motor shafts were obtained from Emerson Electric Co. of St. Louis, Mo. and are used to hold the rotor assemblies. The shafts measure 25 cm in length and 1.5 cm in diameter and the alloy information is shown below in the table. The shaft was set up as the cathode while two cold rolled steel panels were used as anodes arranged so that each panel was placed on opposite sides of the shaft. The voltage and temperature were adjusted as shown in the following table. Also shown in the table is the current density of the anodes

TABLE J

| # | Alloy | Silicate Conc. Wt % | Bath Temp ° C. | Voltage Volts | Current Density mA/cm$^2$ | Bath Time min. | Corrosion Hours |
|---|---|---|---|---|---|---|---|
| VI-A | 1018 | 10% | 75 | 12 | 94–66 | 30 | 16 |
| VI-B | 1018 | 10% | 95 | 18 | 136–94 | 30 | 35 |
| VI-C | 1144 | 10% | 75 | 12 | 109–75 | 30 | 9 |
| VI-D | 1144 | 10% | 95 | 18 | 136–102 | 30 | 35 |
| VI-F | 1215 | 10% | 75 | 12 | 92–52 | 30 | 16 |
| VI-G | 1215 | 10% | 95 | 18 | 136–107 | 30 | 40 |

The shafts were rinsed with de-ionized water to remove any excess silicates that may have been drawn from the bath solution. The panels underwent corrosion testing according to ASTM B117. The time it took for the shafts to reach 5% red rust coverage in the corrosion chamber was recorded as shown in the table.

EXAMPLE 15

This Example illustrates using an electrolytic method to form a mineral surface upon steel fibers that can be pressed into a finished article or shaped into a preform that is infiltrated by another material.

Fibers were cut (0.20–0.26 in) from 1070 carbon steel wire, 0.026 in. diameter, cold drawn to 260,000–280,000 PSI. 20 grams of the fibers were placed in a 120 mnL plastic beaker. A platinum wire was placed into the beaker making contact with the steel fibers. A steel square 1 in by 1 in, was held 1 inch over the steel fibers, and supported so not to contact the platinum wire. 75 ml of 10% solution of sodium silicate (N-Grade PQ corp) in deionized water was introduced into the beaker thereby immersing both the steel square and the steel fibers and forming an electrolytic cell. A 12 V DC power supply was attached to this cell making the steel fibers the cathode and steel square the anode, and delivered an anodic current density of up to about 3 Amps/sq. inch. The cell was placed onto a Vortex agitator to allow constant movement of the steel fibers. The power supply was turned on and a potential of 12 V passed through the cell for 5 minutes. After this time, the cell was disassembled and the excess solution was poured out, leaving behind only the steel fibers. While being agitated, warm air was blown over the steel particles to allow them to dry.

Salt spray testing in accordance with ASTM B-117 was performed on these fibers. The following table lists the visually determined results of the ASTM B-117 testing.

TABLE K

| Treatment | 1st onset of corrosion | 5% red coverage |
|---|---|---|
| UnCoated | 1 hour | 5 hours |
| Electrolytic | 24 hours | 60 |

The following is claimed:

1. An electrically enhanced method for forming a corrosion resistant surface on an electrically conductive surface comprising:

contacting the surface with a medium wherein said medium comprises a combination comprising water, greater than about 2 wt. % of at least one water soluble silicate and at least one dopant, establishing an electroytic environment within the medium wherein the surface is employed as a cathode and an anode comprises at least one member selected from the group consisting of platinum, niobium, titanium and alloys thereof, passing a current through said surface and medium at a rate and period of time sufficient to form a layer upon the surface that imparts improved corrosion resistance to said surface.

2. The method of claim 1 wherein the corrosion resistant surface comprises a reaction product formed between the metal surface and the silicate.

3. The method of claim 1 wherein the surface has an ASTM B-117 exposure time of greater than 2 hours.

4. The method of claim 1 wherein the silicate containing medium comprises greater than 5 wt. % alkali silicate.

5. The method of claim 1 wherein the silicate containing medium comprises at least one member from the group consisting of a fluid bath, gel or spray.

6. The method of claim 1 wherein the silicate containing medium comprises at least one water soluble iron dopant.

7. The method of claim 6 wherein the dopant comprises the anode of the electrolytic environment.

8. The method of claim 1 wherein the silicate containing medium further comprises a water dispersible polymer.

9. The method of claim 1 wherein said medium comprises a combination comprising water, sodium silicate, and an iron dopant.

10. The method of claim 1 further comprising contacting the cathode with a second medium comprising water.

11. A method for improving the corrosion resistance of a metal containing surface comprising:

immersing the metal surface within a medium comprising a combination comprising water, at least one water soluble alkali silicate and at least one dopant, establishing an electrolytic environment within the medium wherein the surface is employed as a cathode and an anode comprises at least one member selected from the group consisting of platinum, niobium, titanium, and alloys thereof, wherein said medium interacts with a portion of the metal surface to form a layer having improved corrosion resistance in comparison to the metal surface.

12. The method of claim 11, wherein the corrosion resistant surface comprises a mineral layer.

13. The method of claim 11 wherein the dopant comprises at least one member selected from the group consisting of molybdenum, chromium, titanium, zirconium vanadium, phosphorus, aluminum, iron, boron, bismuth, gallium, tellurium, germanium, antimony, niobium, magnesium, manganese, and their oxides and salts.

14. A cathode method for forming a mineral coating upon a metal or electrically conductive surface comprising:

exposing the surface to a medium comprising a combination comprising water, at least one water soluble silicate and at least one dopant, establishing an electrolytic environment within the medium wherein the surface is employed as a cathode and an anode comprises at least one member selected from the group consisting of platinum, niobium, titanium and alloys thereof, for a period of time and under conditions sufficient to form a mineral coating upon the metal surface, exposing the mineral coated surface to an acid treatment.

15. The method of claim 14 wherein the silicate containing medium comprises sodium silicate.

16. The method of claim 14 further comprising forming a layer comprising silica upon the mineral.

17. The method of claim 14 wherein said silicate containing medium is substantially solvent free.

18. The method of claim 14 further comprising forming a secondary coating comprising at least one member chosen from the group of silanes and epoxies.

19. A method for treating materials having an electrically conductive surface comprising:

contacting at least a portion of the surface with a medium comprising a combination comprising water, and at least one water soluble silicate, establishing an electrolytic environment in the medium, wherein an anode comprises at least one member from the group consisting of platinum, niobium, titanium and alloys thereof and wherein said at least a portion of the surface is employed as a cathode.

20. The method of claim 19 further comprising applying a secondary coating.

21. The method of claim 20 wherein said secondary coating comprises at least one member selected from the group consisting of acrylics, silanes, urethanes, and epoxies.

22. The method of claim 19 wherein said first medium comprises at least 3 wt. % of at least one water soluble silicate.

23. The method of claim 19 wherein said interaction forms a layer comprising silica and at least one metal silicate.

24. The method of claim 19 further comprising cleaning said surface prior to said contacting.

25. The method of claim 19 further comprising contacting the cathode with a second medium comprising water.

26. The method of claim 19 wherein said medium further comprises at least one water soluble dopant.

27. A process for treating an electrically conductive surface comprising:

contacting at least a portion of the surface with a medium wherein said medium comprises a combination comprising water and at least one water soluble silicate and at least one dopant.

introducing an electrical current into said medium wherein the surface is employed as a cathode and an anode comprises at least one member selected from the group consisting of platinum, niobium, titanium and alloys thereof.

28. The process of claim 27 wherein the surface comprises at least one member selected from the group consisting of lead, copper, zinc, iron, nickel, tin, cadmium, magnesium, aluminum and alloys thereof.

29. The process of claim 27 wherein the metal surface comprises an electric motor component.

30. The process of claim 27 wherein the anode comprises platinum.

* * * * *